US008538294B2

(12) United States Patent
Takami et al.

(10) Patent No.: US 8,538,294 B2
(45) Date of Patent: Sep. 17, 2013

(54) CHARGE-REMOVING DEVICE

(75) Inventors: Yukiko Takami, Inazawa (JP); Takashi Shimizu, Nagoya (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 221 days.

(21) Appl. No.: 13/051,068

(22) Filed: Mar. 18, 2011

(65) Prior Publication Data

US 2011/0243609 A1 Oct. 6, 2011

(30) Foreign Application Priority Data

Mar. 31, 2010 (JP) ..... 2010-083668
Apr. 26, 2010 (JP) ..... 2010-100874

(51) Int. Cl.
*G03G 21/00* (2006.01)

(52) U.S. Cl.
USPC ..... 399/128; 257/98

(58) Field of Classification Search
USPC ..... 399/128
See application file for complete search history.

(56) References Cited

U.S. PATENT DOCUMENTS

| | | | | |
|---|---|---|---|---|
| 5,418,384 | A | 5/1995 | Yamana et al. | |
| 5,850,585 | A | 12/1998 | Tsutsumi et al. | |
| 5,969,343 | A | 10/1999 | Nakamura et al. | |
| 6,268,600 | B1 | 7/2001 | Nakamura et al. | |
| 6,738,588 | B2 * | 5/2004 | Yokomori et al. | 399/111 |
| 2002/0081126 | A1 | 6/2002 | Yokomori et al. | |
| 2003/0210222 | A1 | 11/2003 | Ogiwara et al. | |
| 2006/0060751 | A1 | 3/2006 | Nishimura et al. | |
| 2011/0129254 | A1 | 6/2011 | Oda et al. | |

FOREIGN PATENT DOCUMENTS

| | | | |
|---|---|---|---|
| CN | 1360234 | A | 7/2002 |
| CN | 1752871 | A | 3/2006 |
| CN | 101408749 | A | 4/2009 |
| JP | 62-127786 | A | 6/1987 |
| JP | H02-284102 | A | 11/1990 |
| JP | H05-316296 | A | 11/1993 |
| JP | H08-043633 | A | 2/1996 |
| JP | H10-123898 | A | 5/1998 |
| JP | 2002-189400 | A | 7/2002 |

(Continued)

OTHER PUBLICATIONS

Japan Patent Office, Office Action for Japanese Patent Application No. 2010-100874, mailed Nov. 22, 2011.

(Continued)

*Primary Examiner* — Walter L Lindsay, Jr.
*Assistant Examiner* — Benjamin Schmitt
(74) *Attorney, Agent, or Firm* — Baker Botts L.L.P.

(57) ABSTRACT

In the charge-removing device, the light guide portion extends in a first direction. The light guide portion guides light from the light source toward the surface of the image-bearing member. A charge on the surface of the image-bearing member is removed by the light emitted from the light guide portion. The first surface of the light guide portion opposes the light source. The rear surface is an opposite surface of the confronting surface and has a rough surface part that reflects, toward the confronting surface, the light from the first surface. The closer a position of the increasing portion is to the second surface, the larger the length of the increasing portion becomes. The closer a position of the decreasing portion is to the second surface, the smaller the length of the decreasing portion becomes.

9 Claims, 7 Drawing Sheets

(56) References Cited

FOREIGN PATENT DOCUMENTS

| | | | | |
|---|---|---|---|---|
| JP | 2002-208307 | A | | 7/2002 |
| JP | 2003-295717 | A | | 10/2003 |
| JP | 2005-114894 | A | | 4/2005 |
| JP | 2005114894 | A | * | 4/2005 |
| JP | 2005-275130 | A | | 10/2005 |
| JP | 2006-113216 | A | | 4/2006 |
| JP | 2010-008725 | A | | 1/2010 |
| JP | 2011-112812 | A | | 6/2011 |

OTHER PUBLICATIONS

State Intellectual Property Office of the People'S Republic of China, Notification of First Office Action for Chinese Patent Application No. 201110063766.0 (counterpart to above-captioned patent application), mailed May 24, 3013.

* cited by examiner

| POSITION | Ra (μm) | Rq (μm) | Rz (μm) | Rc (μm) |
|---|---|---|---|---|
| 33.5 | 3.695 | 4.385 | 16.236 | 12.26 |
| 122 | 3.889 | 4.468 | 15.855 | 12.391 |
| 213 | 4.141 | 4.738 | 16.508 | 12.648 |

| | 55mm | 100mm | 145mm | 190mm | 235mm |
|---|---|---|---|---|---|
| EMBODIMENT | 5.2 μW | 5.8 μW | 6.1 μW | 5.2 μW | 5.4. μW |
| COMPARATIVE EXAMPLE | 2.8 μW | 3.8 μW | 4.5 μW | 5.3 μW | 7.2. μW |

CHARGE-REMOVING DEVICE

CROSS REFERENCE TO RELATED APPLICATION

This application claims priority from Japanese Patent Applications No. 2010-083668 filed Mar. 31, 2010, and No. 2010-100874 filed Apr. 26, 2010. The entire contents of the priority applications are incorporated herein by reference.

TECHNICAL FIELD

The invention relates to a charge-removing device.

BACKGROUND

In an electrophotographic-type image-forming device, first an electrostatic latent image is formed on the surface of a photosensitive drum as the drum rotates. Next, toner is supplied by a developing roller to the surface of the photosensitive drum, for developing the electrostatic latent image into a toner image. Subsequently, the toner image carried on the surface of the photosensitive drum is transferred onto a sheet of paper. Through this process, the image-forming device can form images (toner images) on paper.

At this time, any charge remaining on the surface of the photosensitive drum after a toner image has been transferred onto paper can adversely affect the quality of the next electrostatic latent image (toner image) formed on the photosensitive drum. Therefore, some conventional image-forming devices have been provided with a charge-removing device for removing any residual charge from the surface of the photosensitive drum.

One charge-removing device known in the art is provided with an LED array. The LED array is disposed in opposition to the surface of the photosensitive drum and is configured of a plurality of light-emitting diodes (LEDs) aligned along the axis of the photosensitive drum. By emitting light from each LED so that the surface of the photosensitive drum is uniformly irradiated across the entire drum in the axial direction thereof, residual charge can be removed from the surface of the drum.

Another type of charge-removing device known in the art is configured of an LED lamp, and a light guide for guiding light emitted from the LED lamp onto the surface of the photosensitive drum. The light guide is formed of a transparent resin or glass and is bar-shaped. The bar-shaped light guide is positioned opposite the surface of the photosensitive drum so as to extend in the axial direction of the drum. The LED lamp is positioned opposite one endface of the light guide so that light emitted from the LED lamp enters this endface. V-shaped notches formed of recesses and protrusions are provided in the peripheral surface of the light guide for reflecting light entering the endface from the LED lamp onto the surface of the photosensitive drum. In order to prevent a decrease in the quantity of light irradiated onto the surface of the photosensitive drum as the distance from the LED lamp increases, the width and depth of the recesses and protrusions formed in the light guide are increased monotically in the direction away from the LED lamp.

Since the charge-removing device configured of an LED lamp and a light guide requires fewer LEDs than the charge-removing device configured of an LED array, the cost of the charge-removing device can be reduced.

SUMMARY

However, in thorough research conducted by the inventors of the invention, it was discovered that the conventional charge-removing device configured of an LED lamp and a light guide could not irradiate light onto the surface of the photosensitive drum uniformly across the axial direction thereof, even when the width and depth of the protrusions and recessions formed in the light guide were increased monotically in the direction away from the LED lamp or other light source.

Therefore, it is an object of the invention to provide a charge-removing device capable of irradiating light from a light source onto the surface of a photosensitive member so as to be uniform across the photosensitive member in the axial direction.

In order to attain the above and other objects, the invention provides a charge-removing device. The charge-removing device includes a light source and a light guide portion. The light source emits light. The light guide portion confronts a surface of an image-bearing member. The light guide portion extends in a first direction. The light guide portion guides light from the light source toward the surface of the image-bearing member. A charge on the surface of the image-bearing member is removed by the light emitted from the light guide portion. The light guide portion includes a first surface, a second surface, a confronting surface, and a rear surface. The first surface opposes the light source. The second surface is an opposite surface of the first surface in the first direction. The confronting surface connects the first surface and the second surface. The confronting surface confronts the surface of the image-bearing member in a second direction orthogonal to the first direction. The rear surface is an opposite surface of the confronting surface. The rear surface has a rough surface part that reflects, toward the confronting surface, the light entered from the first surface. The rough surface part has a length of a third direction orthogonal to the first direction and the second direction. The rough surface part includes an increasing portion and a decreasing portion. The closer a position of the increasing portion is to the second surface, the larger the length of the increasing portion in the third direction becomes. The closer a position of the decreasing portion is to the second surface, the smaller the length of the decreasing portion in the third direction becomes.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of an Image-Forming Device

Figure 1:
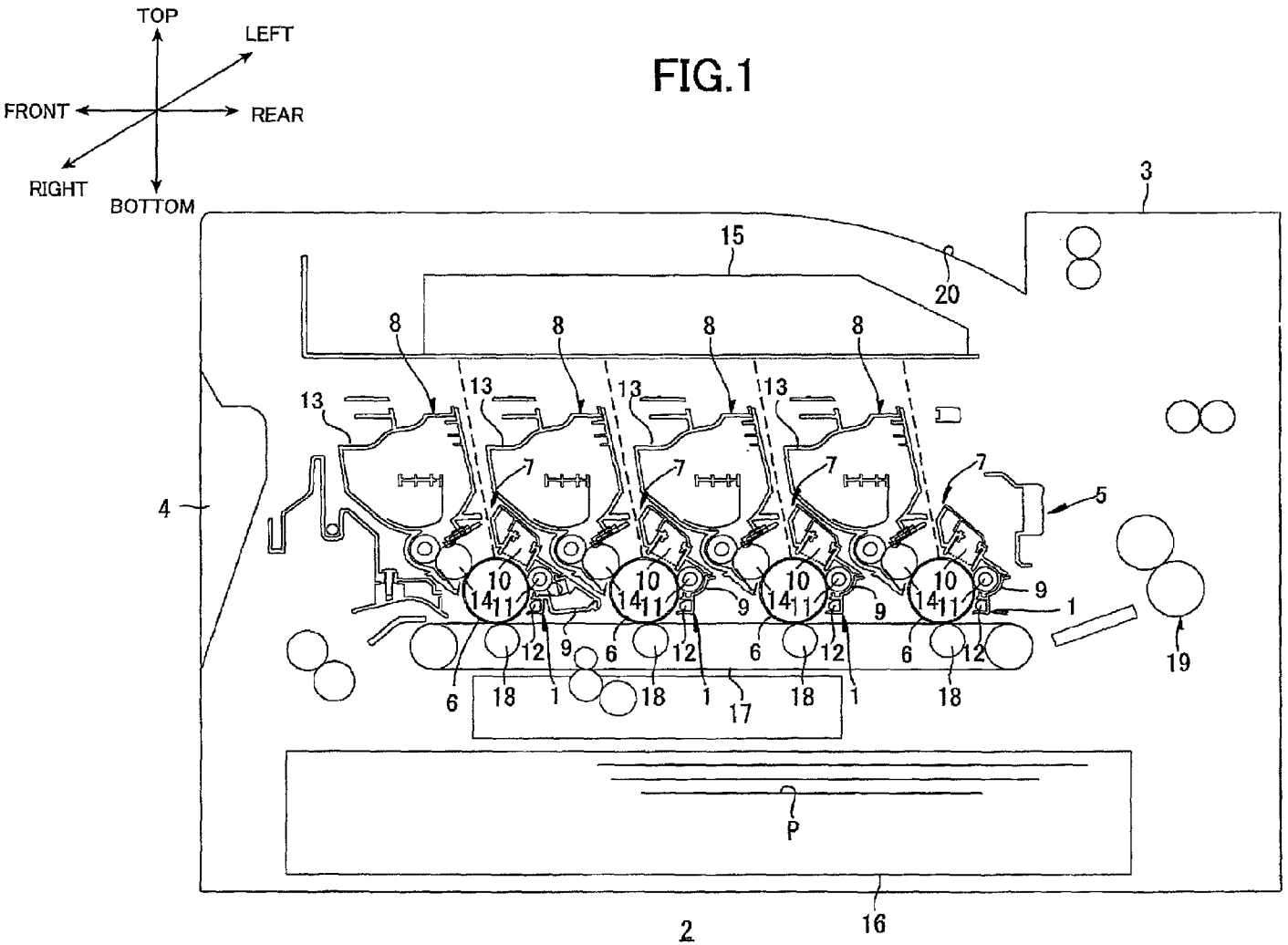
FIG. 1 is a cross section of an image-forming device having a charge-removing device according to an embodiment.

A charge-removing device 1 according to the embodiment of the invention is provided in an image-forming device 2, such as that shown in FIG. 1. The image-forming device 2 is a tandem-type color laser printer, for example. However, the charge-removing device 1 may be provided in a color laser printer other than a tandem-type printer, or a monochrome laser printer.

The image-forming device 2 includes a main casing 3 shaped substantially like a rectangular parallelepiped. A front cover 4 is provided on one side wall of the main casing 3 for covering an access opening providing access to the interior of the main casing 3. A drum unit 5 is removably accommodated in the interior of the main casing 3 and can be removed from the main casing 3 through the access opening when the front cover 4 is open.

In the following description, the side of the main casing 3 on which the front cover 4 is provided will be called the "front side," and the front, rear, top, bottom, left, and right sides of components in the image-forming device 2, including the charge-removing device 1, will be based on the perspective of a user facing the front side of the charge-removing device 1.

The drum unit 5 is provided with four photosensitive drums 6 corresponding to the four colors black, yellow, magenta, and cyan. The photosensitive drums 6 are arranged parallel to each other and are spaced at equal intervals in the front-to-rear direction in the order black, yellow, magenta, and cyan from front to rear.

The drum unit 5 also includes a drum subunit 7 and a developer cartridge 8 for each of the photosensitive drums 6. The drum subunits 7 are fixed relative to the drum unit 5. The developer cartridge 8 can be mounted in or removed from the drum unit 5 from a position above the drum unit 5 when the drum unit 5 is pulled far enough out of the main casing 3.

Each drum subunit 7 includes a frame 9 formed of a synthetic resin. The frame 9 functions to hold chargers 10, cleaning rollers 11, and light guides 12 corresponding to four photosensitive drums 6. The charger 10, the cleaning roller 11, and the light guide 12 are arranged about the circumference of the corresponding photosensitive drum 6 in an order opposite the rotating direction of the photosensitive drum 6 and oppose the circumferential surface of the photosensitive drum 6.

Each developer cartridge 8 includes a case 13 for accommodating toner, and a developing roller 14 held in the lower end of the case 13. The developing roller 14 is positioned so that a portion of its peripheral surface is exposed from the bottom of the case 13. This exposed surface of the developing roller 14 contacts the peripheral surface of the corresponding photosensitive drum 6.

An exposure device 15 is disposed above the drum unit 5 for irradiating four laser beams corresponding to the four colors employed in the image-forming device 2.

In an image-forming operation, as the photosensitive drum 6 corresponding to each toner color rotates, the corresponding charger 10 applies a uniform charge to the surface of the photosensitive drum 6 through corona discharge. Subsequently, the exposure device 15 irradiates laser beams for selectively exposing the surfaces of the photosensitive drums 6. Each laser beam selectively removes charge from the surface of the corresponding photosensitive drum 6, forming an electrostatic latent image thereon. In the meantime, the thin layer of toner carried on the surface of the developing roller 14 is maintained at a uniform thickness. As the electrostatic latent image formed on the photosensitive drum 6 rotates to a position opposite the developing roller 14, the developing roller 14 supplies toner to the latent image, developing the latent image into a visible toner image on the surface of the photosensitive drum 6.

A paper cassette 16 for accommodating sheets of a paper P is disposed in the bottom section of the main casing 3. A conveying belt 17 is disposed between the paper cassette 16 and the drum unit 5 so that the upper portion of the conveying belt 17 is in contact with the four photosensitive drums 6 on their bottom circumferential surfaces. Four transfer rollers 18 are disposed inside the conveying belt 17 at positions confronting each of the photosensitive drums 6 through the upper portion of the conveying belt 17.

The paper P accommodated in the paper cassette 16 is conveyed onto the conveying belt 17 by various rollers. At this time, the conveying belt 17 is circulating so that its upper portion moves in the front-to-rear direction. Thus, when a sheet of paper P is conveyed onto the conveying belt 17, the conveying belt 17 carries the sheet sequentially through positions between the conveying belt 17 and each of the photosensitive drums 6. As the sheet passes beneath each photosensitive drum 6, the corresponding transfer roller 18 functions to transfer the toner image from the surface of the photosensitive drum 6 to the sheet of paper P.

A fixing unit 19 is provided on the downstream end of the conveying belt 17 with respect to the direction that the paper P is conveyed. After toner images are transferred onto the paper P, the paper P is conveyed to the fixing unit 19, where the toner images are fixed to the sheet by heat and pressure. After the toner images are fixed in the fixing unit 19, various rollers discharge the sheet onto a discharge tray 20 formed on the top surface of the main casing 3.

After a toner image is transferred from the photosensitive drum 6 to the paper P, the region on the surface of the photosensitive drum 6 from which the toner image was transferred rotates to a position opposite the light guide 12. A light source 21 shown in FIG. 2 irradiates light into the light guide 12. As described below in detail, light entering the light guide 12 propagates therethrough and irradiates the surface of the photosensitive drum 6 across the entire width direction (left-to-right direction) thereof. Light irradiated from the light guide 12 removes any residual charge from the surface of the photosensitive drum 6 following the transfer operation.

In some cases after a toner image is transferred from the photosensitive drum 6 to the paper P, some toner remains on the portion of the photosensitive drum 6 from which the toner image was transferred. When the photosensitive drum 6 rotates such that this residual toner opposes the cleaning roller 11, the cleaning roller 11 recovers the toner.

2. Charge-Removing Device

Figure 2:
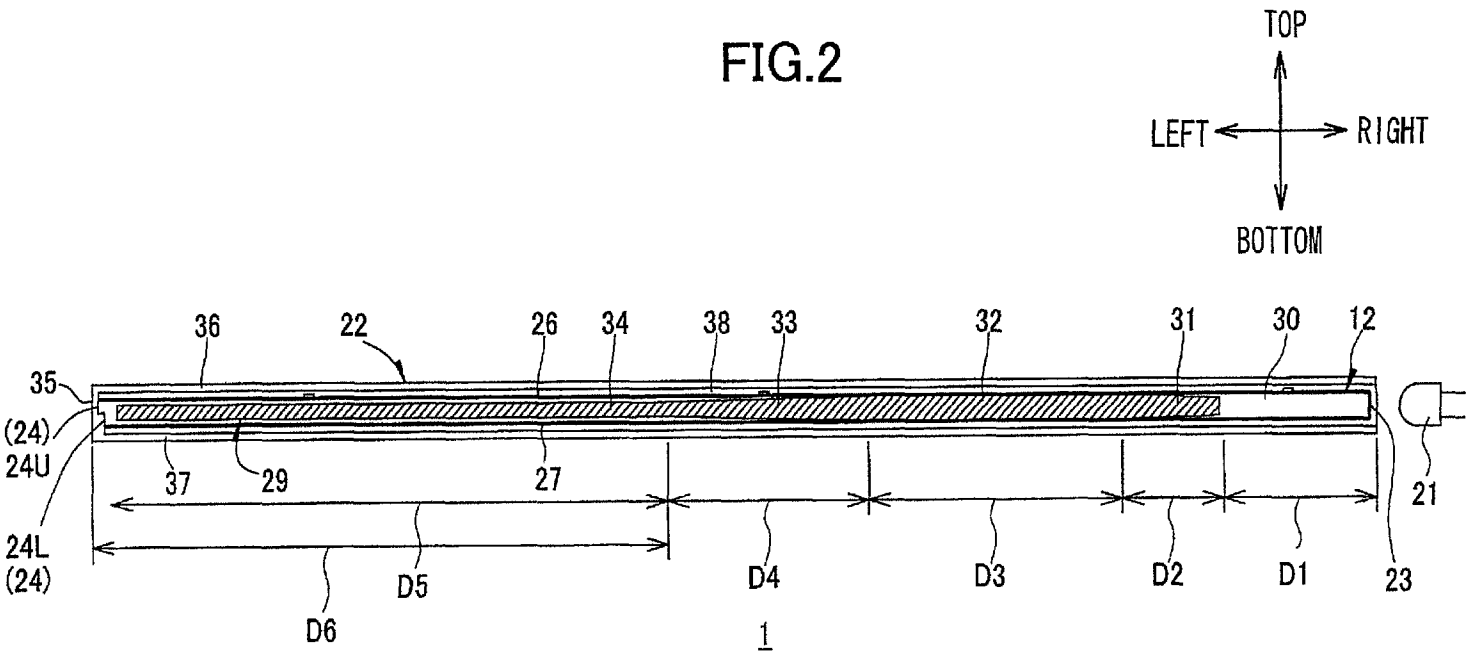
FIG. 2 is a front view of the charge-removing device.

As shown in FIG. 2, the light guide 12 constitutes the charge-removing device 1 together with the light source 21 and a light guide accommodating part 22. The light source 21 is disposed to the right of the light guide 12. The light guide accommodating part 22 accommodates the light guide 12.

(1) Light Guide

The light guide 12 is formed of a colorless, transparent acrylic resin, for example. The light guide 12 is bar-shaped and elongated in the left-to-right direction, i.e., the width direction (axial direction) of the photosensitive drum 6.

The light guide 12 has a flat right endface 23. The right endface 23 serves as the light-incident surface upon which light emitted from the light source 21 is irradiated. That is, the right endface 23 opposes the light source 21. Light incident on the right endface 23 of the light guide 12 travels (passes) through the light guide 12 toward a left endface 24 on the other end of the light guide 12.

The left endface 24 is fabricated to reflect light arriving at the left endface 24 back into the light guide 12. Specifically, the left endface 24 is fabricated to form a stepped shape including an upper part 24U, and a lower part 24L recessed farther rightward than the upper part 24U.

Figures 3, 4:
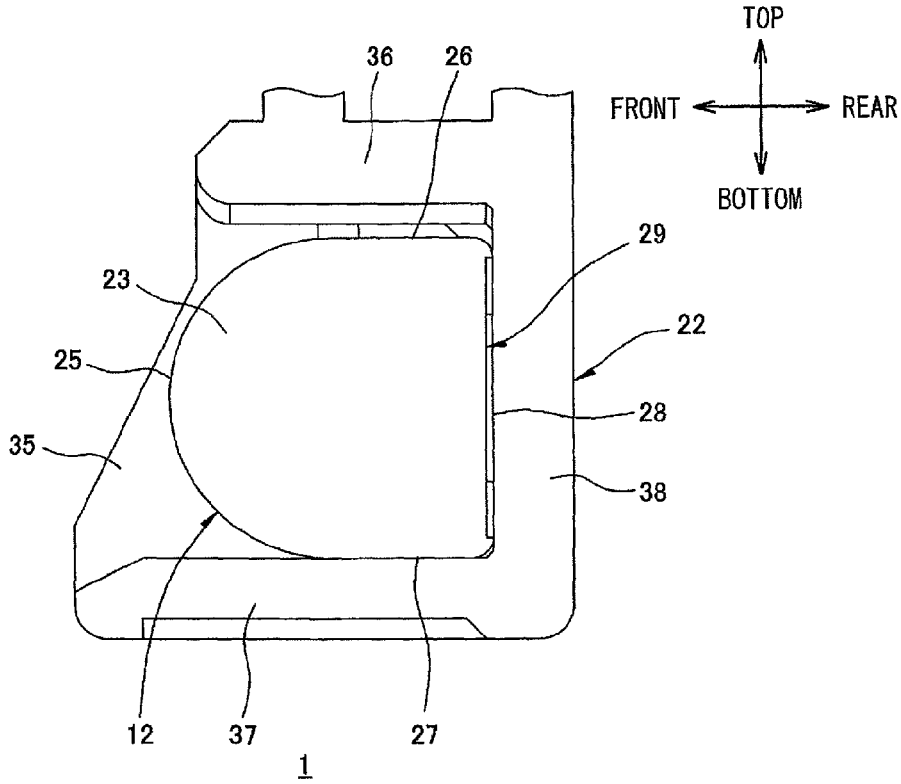
FIG. 3 is a right side view of the charge-removing device.
FIG. 4 is a table showing an arithmetic average roughness Ra, a root mean square roughness Rq, a maximum height of the roughness profile Rz, and a mean height of roughness profile elements Rc of a rough surface part.

As shown in FIG. 3, the circumferential surfaces extending between the right endface 23 and the left endface 24 include a confronting surface 25, a top surface 26, a bottom surface 27, and a rear surface 28.

The confronting surface 25 opposes the surface of the photosensitive drum 6 with a minute gap formed therebetween. The confronting surface 25 is a curved surface of fixed curvature. In a cross section, the confronting surface 25 forms a semicircular arc shape, with the convex side of the arc facing the photosensitive drum 6. Right and left edges of the confronting surface 25 are connected to the right endface 23 and the left endface 24, respectively.

The top surface 26 is a flat surface that extends rearward from the top edge of the confronting surface 25. The right and left edges of the top surface 26 are similarly connected to the right endface 23 and the left endface 24, respectively.

The bottom surface 27 extends rearward from the bottom edge of the confronting surface 25 parallel to the top surface 26. The right and left edges of the bottom surface 27 are similarly connected to the right endface 23 and the left endface 24, respectively.

The rear surface 28 is a flat surface formed on the opposite side of the confronting surface 25 from the photosensitive drum 6. The upper and lower edges of the rear surface 28 are connected respectively to the rear edges of the top surface 26 and the bottom surface 27, and the right and left edges of the rear surface 28 are connected to the right endface 23 and the left endface 24, respectively.

A rough surface part 29 is formed on the rear surface 28 for reflecting light propagating through the light guide 12 toward the confronting surface 25. More specifically, the region of the rear surface 28 opposite the photosensitive drum 6 in the front-to-rear direction (a direction orthogonal to the width direction of the photosensitive drum 6 and to the top-to-bottom direction) is depressed farther inward toward the confronting surface 25 than the remaining regions of the rear surface 28, forming steps between the region opposing the photosensitive drum 6 and the regions not opposing the photosensitive drum 6 with respect to the front-to-rear direction. The depressed region in the rear surface 28 is subjected to surface texturing (an etching process) to form micro-protrusions and micro-depressions therein. This processed region serves as the rough surface part 29 and has a textured surface of uniform roughness.

As shown in FIG. 2, the rough surface part 29 is formed in a region of the rear surface 28 spaced a gap D1 from the right endface 23 of the light guide 12 (i.e., the right end of the rear surface 28). In other words, a gap D1 is formed between the right end of the rough surface part 29 and the right endface 23. The gap D1 is 30 mm. A portion 30 of the rear surface 28 corresponding to the gap D1 is a non-reflective portion. Accordingly, almost no light incident on the right endface 23 is reflected when traveling through the portion 30 of the rear surface 28 toward the left endface 24.

In FIG. 2, the rough surface part 29 has been shaded with hatching lines in order to distinguish the rough surface part 29 from peripheral parts. The rough surface part 29 has a substantially uniform surface roughness.

Beginning from its right edge and progressing sequentially toward its left edge, the rough surface part 29 has an increasing width portion 31, a maximum width portion 32, a decreasing width portion 33, and a minimum width portion 34. That is, the increasing width portion 31 includes the right edge of the rough surface part 29.

The increasing width portion 31 has a length D2 and extends leftward from the right edge of the rough surface part 29. The length D2 is 20 mm. The width of the increasing width portion 31 in a direction orthogonal to the left-to-right direction, i.e., vertically, increases gradually toward the left (toward the left endface 24 of the light guide 12). More specifically, the vertical dimension of the increasing width portion 31 is 3 mm on the right end and 4.2 mm on the left end. Moving from the right end toward the left end of the increasing width portion 31, the vertical dimension of the increasing width portion 31 increases monotonically (gradually) from 3 mm to 4.2 mm. That is, the closer a position of the increasing width portion 31 is to the left endface 24, the larger the vertical dimension of the increasing width portion 31 becomes.

The maximum width portion 32 has a length D3 that is a maximum vertical length among the vertical lengths of the rough surface part 29 and extends leftward from its border with the increasing width portion 31. The length D3 is 50 mm, and the vertical dimension of the maximum width portion 32 is a uniform 4.2 mm.

The decreasing width portion 33 has a length D4 and extends leftward from its border with the maximum width portion 32. The length D4 is 40 mm. The vertical dimension of the decreasing width portion 33 decreases monotonically toward the left (toward the left endface 24 of the light guide 12). More specifically, the vertical dimension of the decreasing width portion 33 is 4.2 mm on the right end and 2.5 mm on the left end. Moving from the right end toward the left end, the vertical dimension of the decreasing width portion 33 decreases gradually from 4.2 mm to 2.5 mm. That is, the closer a position of the decreasing width portion 33 is to the left endface 24, the smaller the vertical dimension of the decreasing width portion 33 becomes.

The minimum width portion 34 is the portion between its border with the decreasing width portion 33 and the left edge of the rough surface part 29 and has a length D5 of 110.5 mm in the left-to-right direction. The length D5 is a minimum vertical length among the vertical lengths of the rough surface part 29. The vertical dimension of the minimum width portion 34 is a uniform 2.5 mm.

A small gap is formed between the left end of the rough surface part 29 and the left end of the light guide 12. A length D6 from the border between the decreasing width portion 33 and the minimum width portion 34 to the left endface of the light guide 12 is 112.9 mm. Thus, the gap between the left end of the rough surface part 29 and the left endface of the light guide 12 is 2.4 mm.

(2) Light Source

The light source 21 is an LED light provided with an LED, for example. The light source 21 is fixed inside the main casing 3 at a position opposing the right endface 23 of the light guide 12 over a prescribed distance (22.9 mm, for example) in the left-to-right direction.

(3) Light Guide Accommodating Unit

The light guide accommodating part 22 is formed in the frame 9 of the drum subunit 7. The light guide accommodating part 22 has a square C-shaped cross section and is open on the front and right sides. The light guide accommodating part 22 has interior space for accommodating the light guide 12. More specifically, the light guide accommodating part 22 has a left wall 35, a top wall 36, a bottom wall 37, and a rear wall 38 respectively corresponding to (and covering) the left endface 24, the top surface 26, the bottom surface 27, and the rear surface 28 of the light guide 12. The right and front sides of the light guide accommodating part 22 are open and expose the right endface 23 and the confronting surface 25 of the light guide 12. The left wall 35 is formed with a step corresponding to the shape of the left endface 24 formed on the light guide 12. The rear wall 38 is shaped to form contact with the entire rear surface 28 formed on the light guide 12. The light guide accommodating part 22 is formed of a non-transparent resin in a color other than black, such as a white resin.

(4) Measurement of Roughness of the Rough Surface Part

The roughness of the rough surface part 29 was measured at three points spaced in the left-to-right direction using a contact-type instrument for measuring surface roughness. Using a position on the rough surface part 29 corresponding to the right edge of the photosensitive drum 6 as a reference point, the three measurement points were set at left positions separated 33.5, 122, and 213 mm from the reference position.

The maximum width portion 32 is formed at a biased position in the left-to-right direction of the rough surface part 29 to the right of the center region.

Parameters, including the arithmetic average roughness Ra, the root mean square roughness Rq, the maximum height of the roughness profile Rz, and the mean height of roughness profile elements Re were found for each point from the above measurements. The calculated values are shown in FIG. 4.

Based on the results shown in FIG. 4, it is readily apparent that the rough surface part 29 has a substantially uniform surface roughness.

3. Operations and Effects

As described above, the light guide 12 is disposed in opposition to the surface of the photosensitive drum 6, extending along the photosensitive drum 6 in the width direction. Light emitted from the light source 21 is incident on the right endface 23 of the light guide 12. The rough surface part 29 is formed in the rear surface 28 constituting the side of the light guide 12 opposite the confronting surface 25, which opposes the surface of the photosensitive drum 6. The rough surface part 29 functions to reflect light incident on the right endface 23 toward the confronting surface 25.

The vertical dimension of the rough surface part 29 does not increase monotonically from the right endface 23 side to the left endface 24 side; rather, the rough surface part 29 has the increasing width portion 31 whose vertical dimension increases in the direction from the right endface 23 side toward the left endface 24 side, and the decreasing width portion 33 whose vertical dimension decreases in the direction from the right endface 23 side toward the left endface 24 side. With this configuration, the rough surface part 29 does not have its maximum vertical dimension at the end portion on the left endface 24 side but rather in a midway portion between the right endface 23 and the left endface 24.

Light incident on the right endface 23 of the light guide 12 travels through the light guide 12 toward the left endface 24 and decays along the path to the left endface 24. Some of the light that reaches the left endface 24 is emitted from the light guide 12 through the left endface 24, while some is reflected back into the light guide 12 by the left endface 24. Therefore, both light traveling from the right endface 23 toward the left endface 24 and light reflected back into the light guide 12 by the left endface 24 are reflected by the rough surface part 29 in the end portion of the rough surface part 29 on the left endface 24 side, and this reflected light is emitted from the confronting surface 25. For this reason, in a conceivable case where a rough surface part 29 has maximum vertical dimension on the end portion near the left endface 24 side, a quantity of reflected light (a larger quantity of light emitted from the confronting surface 25) in the end portion on the left endface 24 side is larger than in portions of the rough surface part 29 closer to the light-incident surface side.

After conducting thorough research, the inventors of the invention discovered that these irregularities in reflected light quantities are one factor preventing the uniform irradiation of light over the surface of the photosensitive drum 6 in the width direction. In order to eliminate these irregularities in reflected light quantities, the inventors formed the rough surface part 29 with its maximum width at a midway point between the right endface 23 and the left endface 24 rather than at the end region near the left endface 24. Compared to the conceivable example having the maximum width at the end region of the rough surface part 29 near the left endface 24, the construction of the rough surface part 29 according to the embodiment can suppress the quantity of light reflected by the light guide 12 in the end portion of the rough surface part 29 near the left endface 24 while increasing the quantity of reflected light in the portions of the rough surface part 29 closer to the light-incident surface side than the end region near the left endface 24.

More specifically, the inventors formed the increasing width portion 31 as the right end portion of the rough surface part 29 and formed the decreasing width portion 33 as a region of the rough surface part 29 near the left side of the increasing width portion 31 and separated from the increasing width portion 31 in the width direction. Further, the maximum width portion 32, having a uniform vertical dimension set at the maximum width, was formed to connect the increasing width portion 31 and decreasing width portion 33. Further, the minimum width portion 34, having a uniform vertical dimension set at the minimum width, was formed to connect to the left side of the decreasing width portion 33. The maximum width portion 32 is formed at a biased position in the left-to-right direction of the rough surface part 29 to the right of the center position of the rough surface part 29.

With this construction, the rough surface part 29 ensures that light emitted from the confronting surface 25 of the light guide 12 is uniform across the longitudinal dimension thereof (the width direction of the photosensitive drum 6). Thus, light emitted from the light source 21 can be irradiated uniformly over the surface of the photosensitive drum 6 across the width direction thereof.

Since the rough surface part 29 has a uniform roughness, the amount of light reflected by the rough surface part 29 is dependent on the width thereof. Accordingly, by varying the width of the rough surface part 29, it is possible to adjust the quantity of light reflected thereby. Thus, use of the rough surface part 29 is a simple method for ensuring that light irradiated over the surface of the photosensitive drum 6 (light emitted from the confronting surface 25) is uniform in the width direction.

The confronting surface 25 is a curved surface having a fixed curvature with its convex side facing the photosensitive drum 6. Thus, light exiting the light guide 12 through the confronting surface 25 is bent uniformly by the confronting surface 25. As a result, the light can be irradiated uniformly in the width direction onto the surface of the photosensitive drum 6.

The rear surface 28, on the other hand, is flat and, hence, can contact the rear wall 38 of the light guide accommodating part 22 across its entire surface. As a result, it is possible to prevent light from leaking out of the rear surface 28, thereby improving the efficiency in which light is emitted from the confronting surface 25.

The rear surface 28 has stepped parts formed between the rough surface part 29 and the region outside the rough surface part 29. With this construction, the rough surface part 29 is formed a step closer toward the confronting surface 25 than the region outside the rough surface part 29 and, therefore, is also positioned closer to the surface of the photosensitive drum 6 than the region outside the rough surface part 29. Accordingly, light reflected off the rough surface part 29 can be irradiated onto the surface of the photosensitive drum 6 more efficiently.

The gap D1 is formed between the end of the rough surface part 29 on the right endface 23 side and the right endface 23. That is, the light guide 12 has the portion 30 on which the rough surface part 29 is not formed positioned between the right endface 23 and the right endface 23 side end of the rough surface part 29. It would be possible to eliminate the portion 30 and align the edge of the rough surface part 29 on the right endface 23 side with the light-incident surface on which light from the light source 21 is incident. However, providing the light guide 12 with the portion 30 makes it possible to shorten the distance from the light source 21 to the light-incident surface so that light emitted from the light source 21 strikes the light-incident surface more efficiently. Consequently, light emitted from the light source 21 can be irradiated more efficiently onto the surface of the photosensitive drum 6.

The left endface 24 has been processed for reflecting light back into the light guide 12 after the light has passed through the light guide 12 and reached the left endface 24. Specifically, the lower part 24L is formed by cutting a notch out of the left endface 24. With this configuration, light traveling from the right endface 23 toward the left endface 24 can be actively reflected back into the light guide 12 by the left endface 24, thereby improving light emission efficiency from the confronting surface 25.

The left endface 24 and the rear surface 28 of the light guide 12 are covered with the light guide accommodating part 22, which is formed of a non-transparent resin in a color other than black, and specifically a white resin. Accordingly, light emitted from the left endface 24 and the rear surface 28 of the light guide 12 can be reflected back into the light guide 12 by the light guide accommodating part 22, thereby further improving light emission efficiency from the confronting surface 25.

4. Variations of the Embodiment

While the invention has been described in detail with reference to the embodiment thereof, it would be apparent to those skilled in the art that various changes and modifications may be made therein without departing from the spirit of the invention.

(1) First Variation

Figure 5:
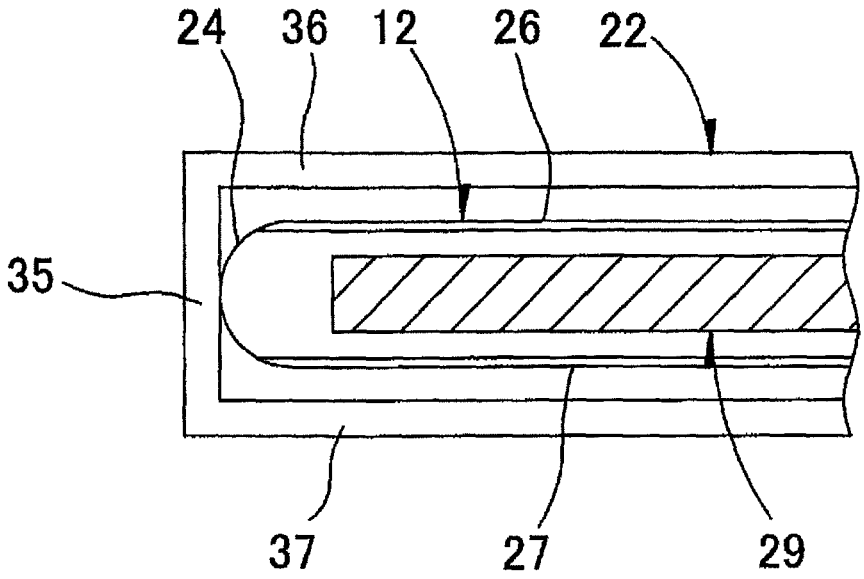
FIG. 5 is a front view of a charge-removing device according to a first variation.
Figure 6:
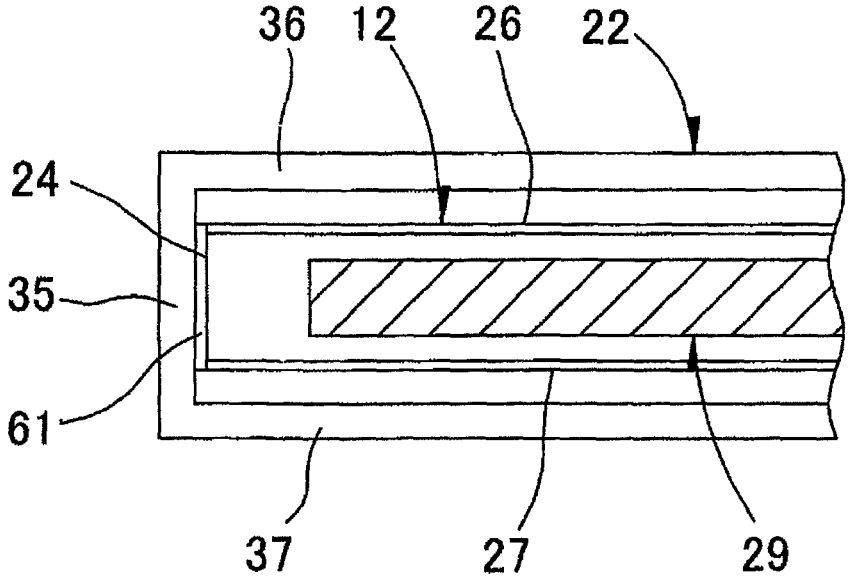
FIG. 6 is a front view of a charge-removing device according to a second variation.

In the example shown in FIG. 2, the left endface 24 of the light guide 12 has been processed so that the lower part 24L is recessed a step rightward from the upper part 24U, as an example of processing the left endface 24 to reflect light back into the light guide 12. However, the left endface 24 may be formed as a hemispherical surface with its convex side on the left, as shown in FIG. 5, for achieving the same objective, (2) Second Variation Alternatively, as shown in FIG. 6, the left endface 24 of the light guide 12 may be formed flat, and a reflective film 61, such as a silver thin film may be formed on the left endface 24 through a plating process.

Alternatively, the left endface 24 may be formed as a flat surface, and micro-protrusions and micro-depressions may be formed in the left endface 24 through surface texturing.

Next, the charge-removing device according to the embodiment of the invention will be compared to a comparative device (hereinafter referred to as the "comparative example"). However, the invention is not limited to the charge-removing device of the embodiment.

Figure 7:
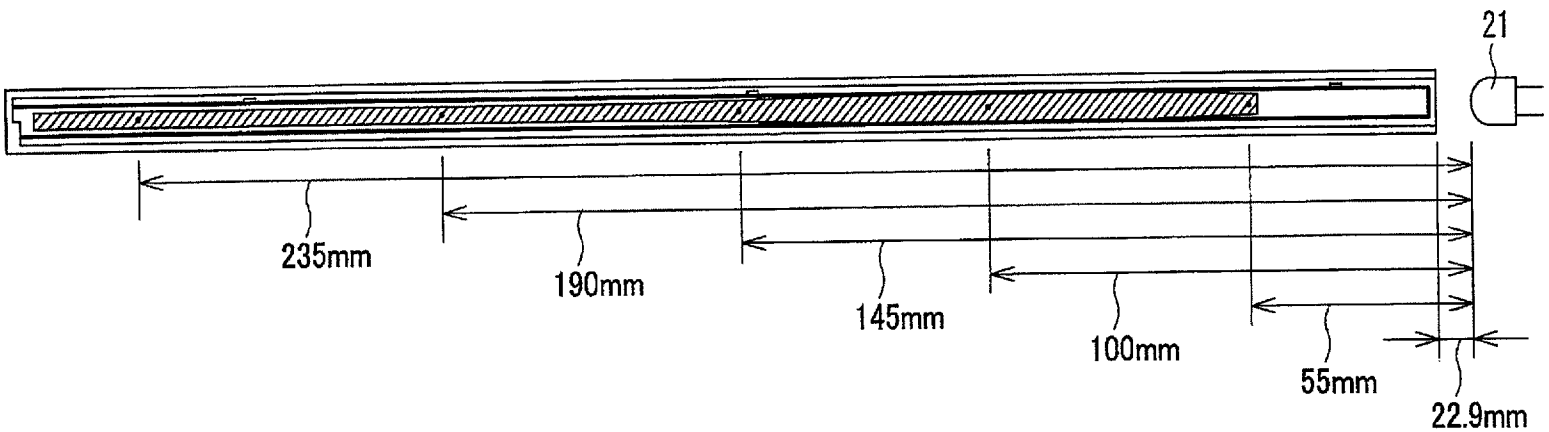
FIG. 7 is a front view of the charge-removing device according to the embodiment.

As shown in FIG. 7, the charge-removing device according to the embodiment is manufactured with the same structure as the charge-removing device 1 shown in FIG. 2 (i.e., the structure according to the embodiment of the invention).

Figure 8:
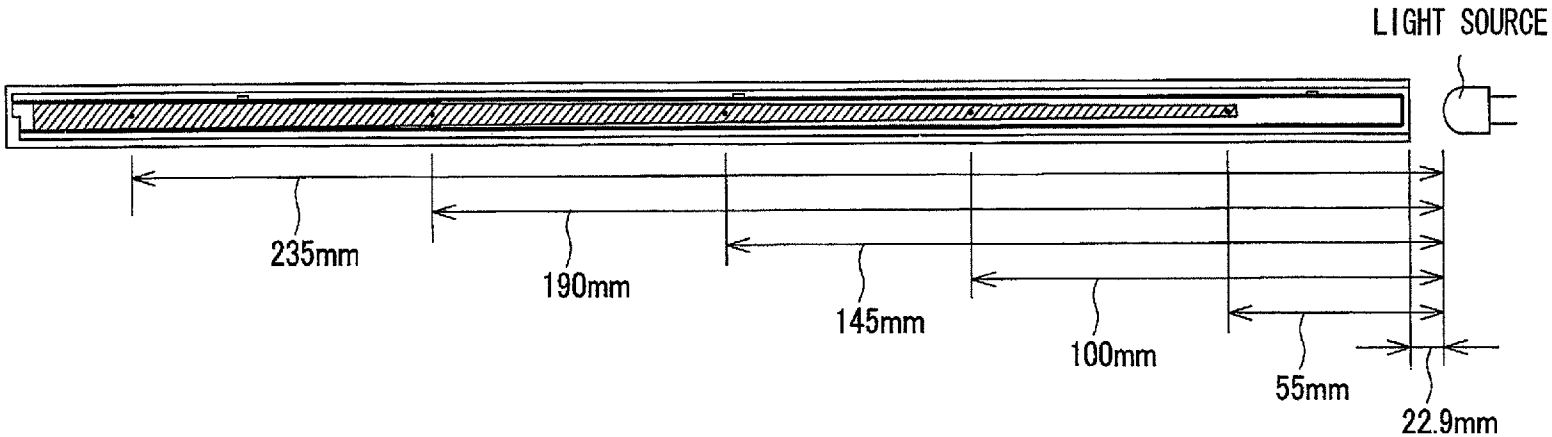
FIG. 8 is a front view of a charge-removing device according to a comparative example.

The charge-removing device in the comparative example, on the other hand, has the structure shown in FIG. 8. The charge-removing device shown in FIG. 8 has the maximum width at the left end region of the rough surface part. Excluding the shape of the rough surface part formed on the rear surface of the light guide, the structure of the charge-removing device shown in FIG. 8 has the same structure as the charge-removing device shown in FIG. 7. The rough surface part shown in FIG. 8 has a length of 220.5 mm along the longitudinal direction of the light guide and is spaced a gap of 30 mm from the longitudinal endface of the light guide (the light-incident surface on which light emitted from the light source is incident). The width of the rough surface part (that is, the dimension in a direction orthogonal to the longitudinal direction of the light guide) on the endface nearest the light source is 1.5 mm, while the width on the opposite end is 4.2 mm.

Using the charge-removing devices according to the embodiment and the comparative example, the quantity of light emitted from their corresponding light guides was measured. In these measurements, an LED light emitting infrared light at a wavelength of 780 nm was provided as the light source and positioned a distance of 22.9 mm from the endface of each light guide. Optical power meters for measuring light intensity were positioned at distances of 55, 100, 145, 190, and 235 mm from the light source.

Figures 9, 10:
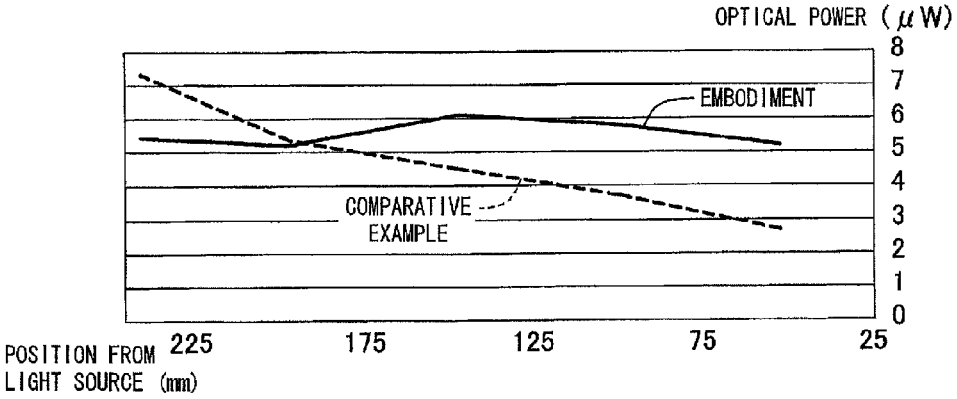
FIG. 9 is a table showing a measurement result of optical powers of the charge-removing devices according to the embodiment and the comparative example.
FIG. 10 is a graph showing the measurement result of optical powers of the charge-removing devices according to the embodiment and the comparative example.

The light source used in the experiment is the SLI-580UT manufactured by ROHM (a high-brightness circular-type, with a diameter of 5.0 mm). The measuring instrument used in the experiment is the Optical Power Meter 3664 manufactured by Hioki E.E. Corporation. A gap of 2 mm was set between each light guide and the optical power meter. The table in FIG. 9 and the graph in FIG. 10 show the measurement results. In the graph of FIG. 10, the horizontal axis represents the distance from the light source (mm), while the vertical axis represents the optical power (μW).

As shown in the table of FIG. 9, optical power produced by the charge-removing device according to the comparative example was 2.8, 3.8, 4.5, 5.3, and 7.2 μW at the respective distances from the light source of 55, 100, 145, 190, and 235 mm. Thus, the optical power reaches a maximum of 7.2 μW at a position 235 mm from the light source and a minimum of 2.8 μW at a position 55 mm from the light source. The difference between the maximum and minimum values is 4.4

On the other hand, optical power produced by the charge-removing device according to the embodiment was 5.2, 5.8, 6.1, 5.2, and 5.4 μW at the respective distances from the light source of 55, 100, 145, 190, and 235 mm. Thus, the optical power reaches a maximum of 6.1 μW at a position 145 mm from the light source and a minimum of 5.2 μW at positions 55 mm and 190 mm from the light source. The difference between the maximum and minimum values is 0.9 μW.

These results confirm that the charge-removing device according to the embodiment has superior balance in the quantity of light emitted from the light guide (greater uniformity of optical power in the longitudinal direction of the light guide) to the charge-removing device of the comparative example.

What is claimed is:

1. A charge-removing device comprising:

a light source that emits light; and a light guide portion that confronts a surface of an image-bearing member, the light guide portion extending in a first direction, the light guide portion guiding light from the light source toward the surface of the image-bearing member, a charge on the surface of the image-bearing member being removed by the light emitted from the light guide portion;

wherein the light guide portion includes:

a first surface opposing the light source;

a second surface that is an opposite surface of the first surface in the first direction;

a confronting surface connecting the first surface and the second surface, the confronting surface confronting the surface of the image-bearing member in a second direction orthogonal to the first direction; and a rear surface that is an opposite surface of the confronting surface, the rear surface having a rough surface part that reflects, toward the confronting surface, the light entered from the first surface, the rough surface part having a length of a third direction orthogonal to the first direction and the second direction;

wherein the rough surface part includes:

an increasing portion;

a decreasing portion;

a first edge;

a second edge opposing the first edge in the first direction and being closer to the second surface than the first edge, one edge of the increasing portion being coincident with the first edge; and a maximum portion and a minimum portion, the maximum portion having a constant maximum length of the rough surface part in the third direction, the minimum portion having a constant minimum length of the rough surface part in the third direction, wherein the closer a position of the increasing portion is to the second surface, the larger the length of the increasing portion in the third direction becomes, wherein the closer a position of the decreasing portion is to the second surface, the smaller the length of the decreasing portion in the third direction becomes, and wherein the increasing portion, the maximum portion, the decreasing portion, and the minimum portion are sequentially arranged in the first direction in this order.

2. The charge-removing device according to claim 1, wherein the rough surface part has an uniform surface roughness.

3. The charge-removing device according to claim 1, wherein the rough surface part includes a maximum portion that has a maximum length of the rough surface part in the third direction, the maximum portion being formed at a position shifted to a side of the first surface from a center position of the rough surface part in the first direction.

4. The charge-removing device according to claim 1, wherein the confronting surface is a curved convex surface having a fixed curvature and facing the image-bearing member.

5. The charge-removing device according to claim 1, wherein the rear surface is a flat surface.

6. The charge-removing device according to claim 1, wherein the rear surface further includes an outer surface part, the rough surface part being depressed farther inward toward the confronting surface than the outer surface part.

7. The charge-removing device according to claim 1, wherein a gap in the first direction is formed between the first surface and the rough surface part.

8. The charge-removing device according to claim 1, wherein the second surface is fabricated to reflect light arriving at the second surface through the light guide portion back into the light guide portion.

9. The charge-removing device according to claim 1, further comprising a cover covering the second surface and the rear surface, the cover being formed of a non-transparent resin in a color other than black.

* * * * *